US005505012A

United States Patent [19]

Walker et al.

[11] Patent Number: 5,505,012

[45] Date of Patent: Apr. 9, 1996

[54] DIRECTIONALLY YIELDABLE-CLEAT ASSEMBLY

[75] Inventors: Andrew S. Walker, 815 Southfield, Birmingham, Mich. 48009; Elwyn Gooding, Ann Arbor, Mich.

[73] Assignee: Andrew S. Walker, Birmingham, Mich.

[21] Appl. No.: 346,006

[22] Filed: Nov. 29, 1994

Related U.S. Application Data

[62] Division of Ser. No. 78,628, Jun. 15, 1993, Pat. No. 5,377,431.

[51] Int. Cl.[6] ..... A43C 15/16; A43C 15/00; A43B 5/00

[52] U.S. Cl. ..... 36/134; 36/59 R; 36/67 R; 36/67 A; 36/59 C

[58] Field of Search ..... 36/59 R, 61, 62, 36/67 R, 67 A, 67 B, 67 C, 67 D, 59 A, 59 B, 127, 128, 134

[56] References Cited

U.S. PATENT DOCUMENTS

| | | | |
|---|---|---|---|
| 1,229,278 | 6/1917 | Johnson | 36/59 R |
| 2,423,753 | 7/1947 | Brooks | 36/59 A |
| 3,352,034 | 11/1967 | Braun | 36/67 D |
| 3,680,231 | 8/1972 | Dymond | 36/59 R |
| 3,898,751 | 8/1975 | Gustin | 36/67 D |
| 4,470,207 | 9/1984 | Bente | 36/134 |
| 4,492,047 | 1/1985 | Arff | 36/62 |
| 4,791,692 | 12/1988 | Collins | 36/67 A |
| 4,833,796 | 5/1989 | Flemming | 36/67 D |
| 5,077,916 | 1/1992 | Beneteau | 36/59 R |
| 5,377,431 | 1/1995 | Walker et al. | 36/67 R |

*Primary Examiner*—Paul T. Sewell
*Assistant Examiner*—Marie Denise Patterson
*Attorney, Agent, or Firm*—Brooks & Kushman

[57] ABSTRACT

The present invention relates to a directionally yieldable cleat assembly attached to an athletic shoe having an upper and a sole with a longitudinal axis. A plurality of spaced cleats are mounted to the sole so that the cleats protrude outwardly from the bottom of the sole. In one embodiment, a bumper is provided between the cleat and the sole for enabling a greater magnitude of deformation or deflection of the cleat in response to a predetermined lateral force imposed upon the cleat in a first laterally inward direction with respect to the longitudinal axis of the shoe than the deformation or deflection of the cleat in response to the same predetermined force imposed on the cleat in direction other than the first lateral direction. Deflection of the cleat is also minimized or eliminated in response to forces imposed on the cleats in a parallel direction to the longitudinal axis of the sole to ensure that traction for the shoe is uncompromised.

9 Claims, 5 Drawing Sheets

DIRECTIONALLY YIELDABLE-CLEAT ASSEMBLY

This is a divisional of application, Ser. No. 08/078,628 filed on Jun. 15, 1993, now U.S. Pat. No. 5,377,431.

BACKGROUND OF THE INVENTION

1. Field of the Invention

The present invention relates generally to cleats for an athletic shoe.

2. Description of the Prior Art

Many athletic sports utilize cleated athletic shoes in order to improve the traction for the player. In the conventional fashion, the cleats improve traction for the player by partially embedding into or otherwise gripping the ground surface as the player runs, pivots and the like.

Although the previously known cleated athletic shoes improve traction for the player while running, they also increase the risk of injury to the athlete's knee and ankle ligaments. More specifically, since cleated athletic shoes partially embed into the ground or firmly grip the ground, a laterally inward impact on the players lower extremities would normally cause the players lower extremities to deflect inwardly. However, since the cleats on these previously known athletic shoes grip the ground and resist this laterally inward movement, injuries can and do occur. Certain types of injuries, such as injuries to the ligaments, cartlidge and other soft tissue, can cause permanent damage to the player.

SUMMARY OF THE PRESENT INVENTION

The present invention provides a directionally yieldable cleat assembly for an athletic shoe which overcomes the above mentioned disadvantages of the previously known shoes.

In brief, the athletic shoe incorporating the cleat assembly of the present invention includes an upper having a sole with a longitudinal axis. A plurality of cleats are secured to the bottom of the sole so that the cleats protrude outwardly from the sole and are adapted to engage and partially embed into or firmly grip the ground support surface Unlike the previously known cleated athletic shoes, however, athletic shoes incorporating the present invention include means for mounting the cleat to the sole which enables a greater magnitude of lateral deformation or deflection of the cleat in response to a predetermined magnitude of shear force imposed upon the cleat in a laterally inwardly directed first direction with respect to the longitudinal axis of the shoe than deformation or deflection of the cleat in response to the same predetermined magnitude of force imposed upon the shoe in all other shear directions. Thus, the cleat of the present invention deforms in response to a laterally inward force imposed upon a players lower extremities which protects the player from injury. Conversely a lesser or no deformation of the cleat occurs in response to shear forces imposed upon the cleat in all other directions thereby maintaining traction of the athletic shoe in the desired fashion.

The present invention provides a number of different embodiments to achieve the above described lateral deformation of the cleat. In one embodiment, a bumper is provided between the cleat and the sole of the shoe which increases in size from one lateral side of the cleat to the other lateral side of the cleat. This bumper enables lateral deformation of the cleat in only one lateral direction but resists deformation of the cleat in all other shear directions.

And still a further embodiment of the present invention, a mounting plate is secured to the sole of the shoe by a post. The post, in turn, registers with a channel formed in the mounting plate so that the mounting plate can move transversely in only one lateral direction. The cleat, in turn, is secured to the mounting plate.

Still other embodiments of the present invention are disclosed in this application.

BRIEF DESCRIPTION OF THE DRAWING

A better understanding of the present invention will be had upon reference to the following detailed description, when read in conjunction with the accompanying drawings. wherein like reference characters refer to like parts throughout the several views, an in which.

Figure 10A:
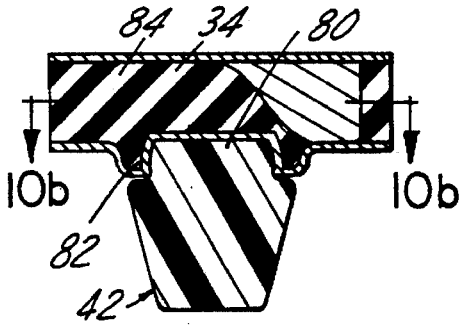

FIG. **10*a*** is a cross sectional view illustrating still a further embodiment of the cleat of the present invention;

FIG. **10*b* is a cross sectional view taken along line 10*b*—10*b* in FIG. 10*a*;**

Figure 11:
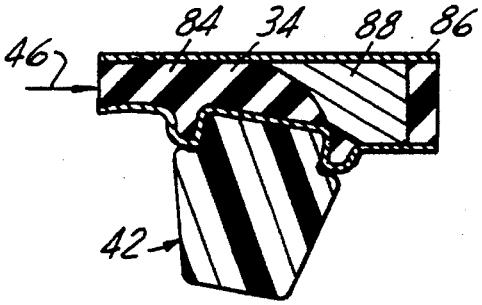
Figure 12:
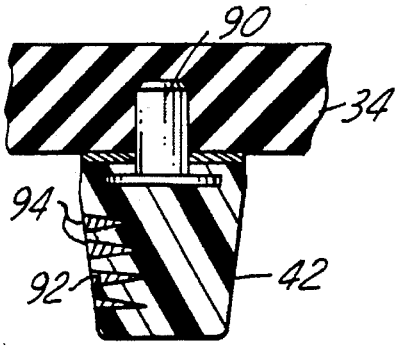
Figure 13:
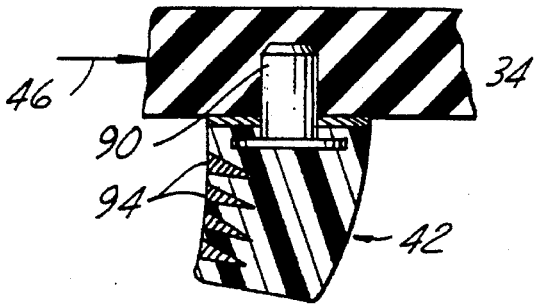
Figure 14:
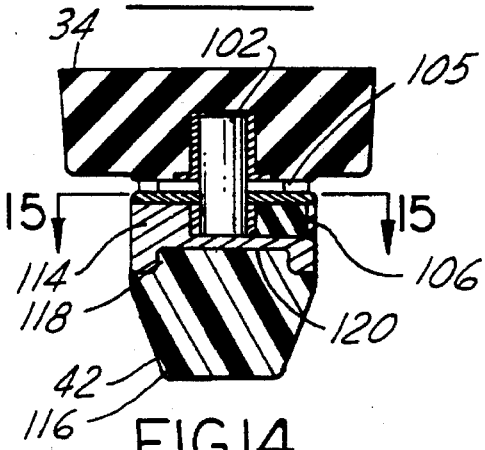
Figure 16:
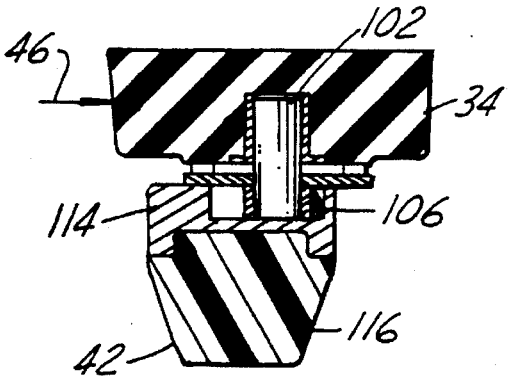
Figure 15:
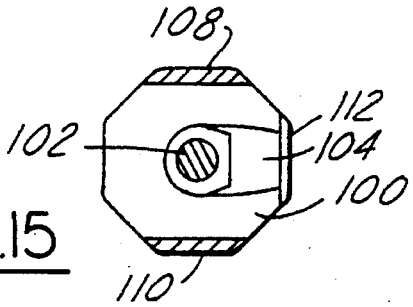
Figure 17:
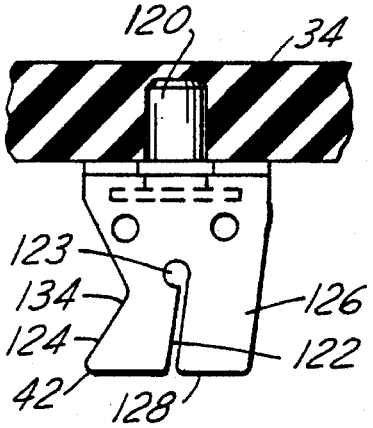
Figure 18:
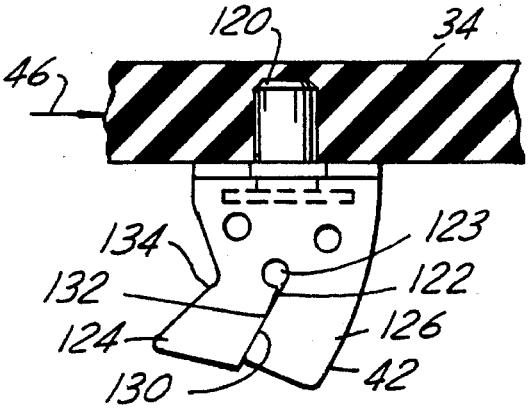
Figure 19:
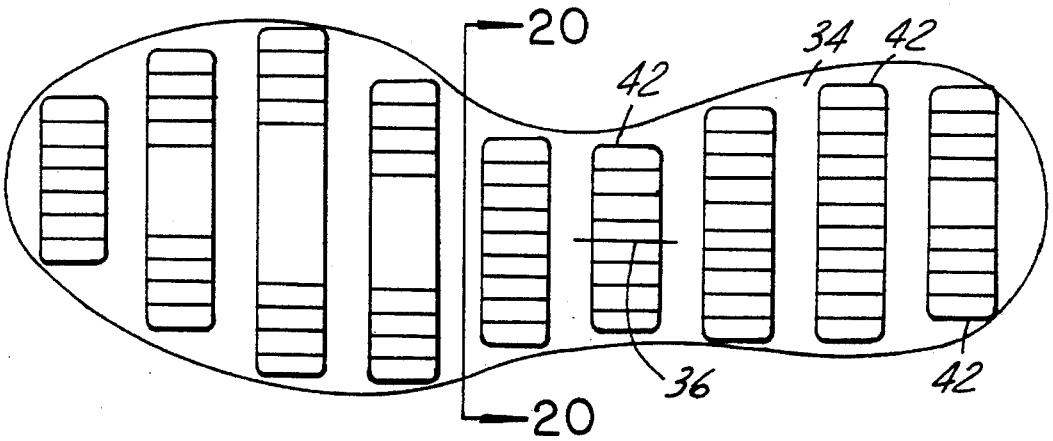
Figure 20:
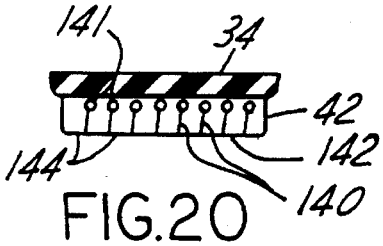
Figure 21:
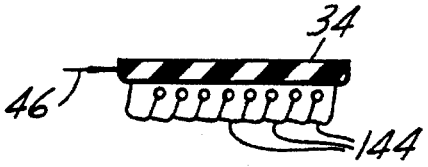
Figure 22:
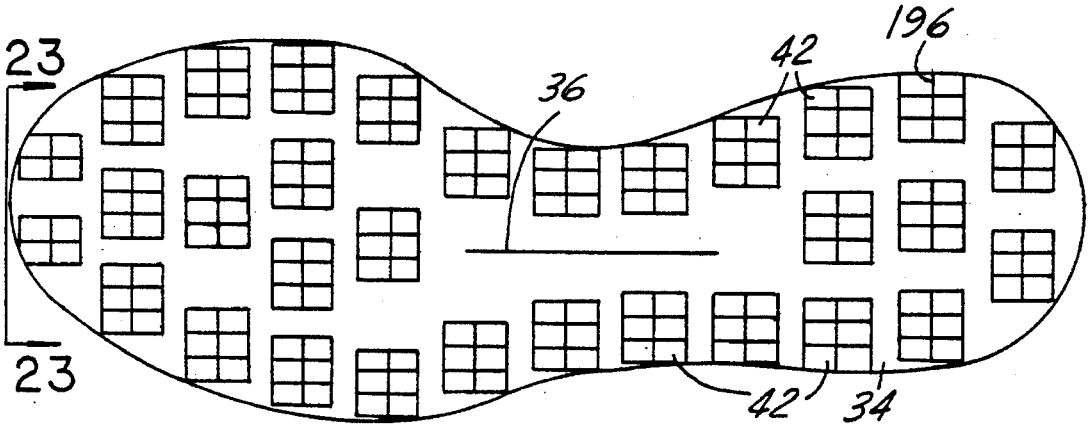
Figure 23:
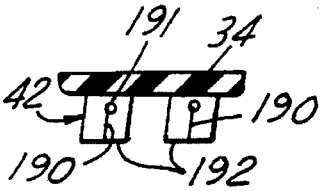
Figure 24:
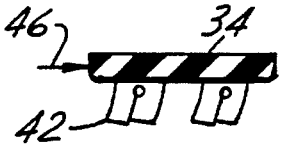
Figure 25:
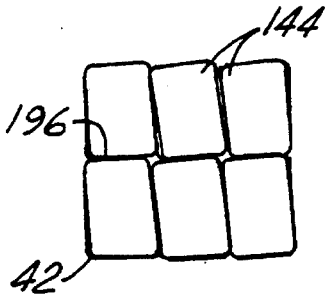
Figure 26:
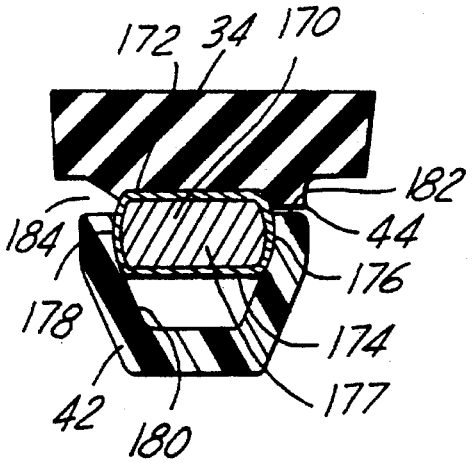
Figure 27:
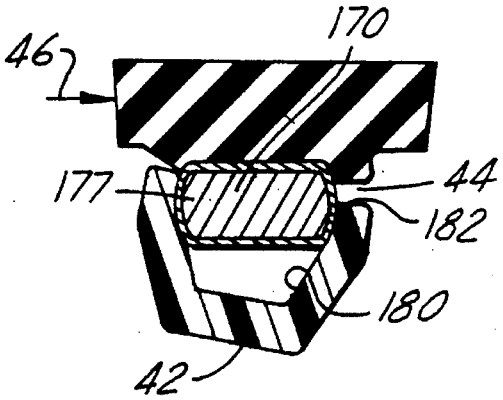
Figure 28:
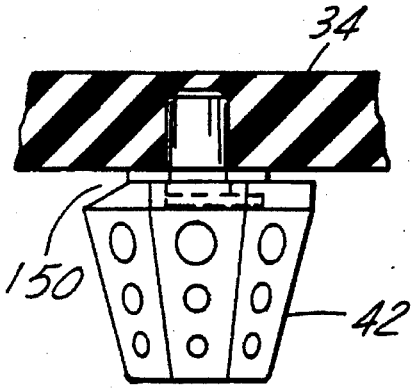
Figure 29:
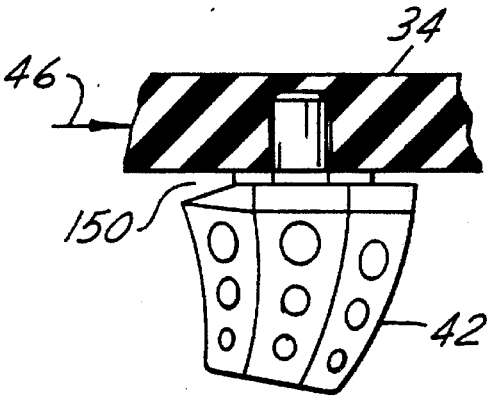

FIG. 11 is a view similar to FIG. **10*a*,** but illustrating the cleat in a deformed condition;

FIG. 12 is a cross sectional view of still a further embodiment of the cleat of the present invention;

FIG. 13 is a view similar to FIG. 12, but illustrating the cleat in a deformed condition;

FIG. 14 is a cross sectional view illustrating still a further embodiment of the cleat of the present invention;

FIG. 15 is a cross sectional view taken substantially along line 15—15 in FIG. 14;

FIG. 16 is a view similar to FIG. 14, but illustrating the cleat in a laterally deformed position;

FIG. 17 is a cross sectional view illustrating still a further modification of the cleat of the present invention;

FIG. 18 is a view similar to FIG. 17, but illustrating the cleat in a laterally deformed condition;

FIG. 19 is a bottom plan view illustrating a still further embodiment of the athletic shoe of the present invention;

FIG. 20 is a view taken substantially along line 20—20 in FIG. 19;

FIG. 21 is a view similar to FIG. 20, but illustrating the cleats in a deformed condition;

FIG. 22 is a view similar to FIG. 19 but illustrating a modification thereof;

FIG. 23 is a view taken along line 23—23 in FIG. 22;

FIG. 24 is a view similar to FIG. 23 but showing the cleats in a deformed condition;

FIG. 25 is a bottom view illustrating the cleats in a deformed condition and enlarged for clarity;

FIG. 26 is a cross sectional view illustrating a still further embodiment of my invention;

FIG. 27 is a view similar to FIG. 26 but illustrating the cleat in a deformed condition;

FIG. 28 is a view illustrating a still further embodiment of the invention; and FIG. 29 is a view similar to FIG. 22, but illustrating the cleat in a deformed condition.

DETAILED DESCRIPTION OF PREFERRED EMBODIMENTS OF THE PRESENT INVENTION

Figure 1:
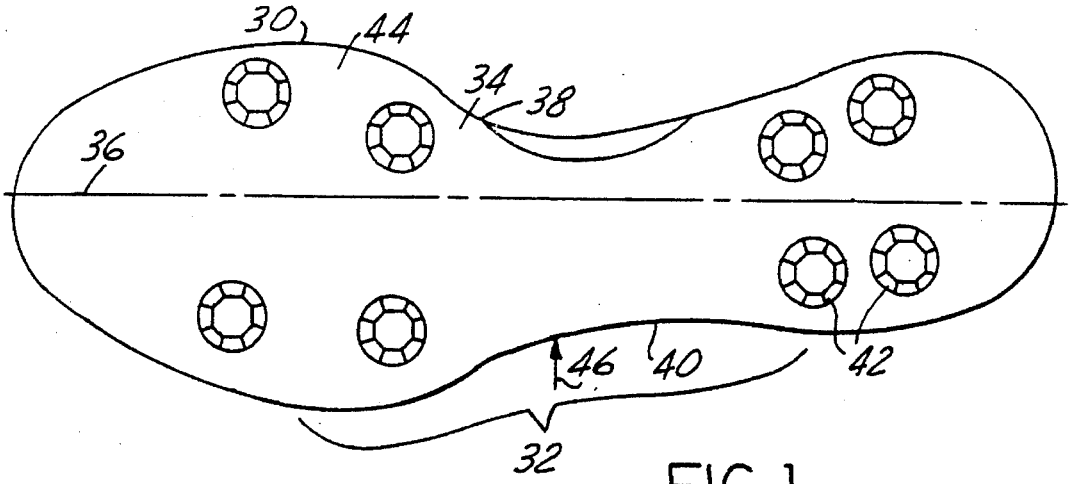
FIG. 1 is a bottom view of an athletic shoe illustrating a preferred embodiment of the present invention.

With reference first to FIG. 1, a right athletic shoe 30 is there shown having an upper 32 and a sole 34. The sole 34 has a longitudinal axis 36, and an inside surface 38 and an outside surface 40.

A plurality of spaced cleats 42 are provided on the sole 34 so that the cleats 42 protrude outwardly from a bottom 44 of the sole. These cleats are adapted to embed into a ground support surface in order to improve traction for the athletic player.

During athletic play, the imposition of a laterally inward force, as depicted by arrow 46, can cause serious injury to the athlete and particularly injury to the athletes cartilage and ligaments in the knee and ankle. However, during normal running, the athlete exerts negligible force in the direction of arrow 46 with respect to the cleats 42. Consequently, as will be here and after described in greater detail, by selectively enabling deformation of the cleats 42 in response to a transverse or lateral force in the direction of arrow 46, the risk of injury to the player is reduced. Conversely, as will be here and after described in greater detail, transverse deformation of the cleats 42 is inhibited in all other shear directions, i.e. forces in a plane parallel to the plane of the sole 34 other than direction 46 so that the traction for the athletic shoe 30 is not compromised.

With reference first to FIGS. 26 and 27, a first preferred embodiment of the present invention is thereshown in which the cleat 42 protrudes downwardly from the bottom 44 of the sole 34. A cylindrical mounting member 170 has one end 172 attached to the sole 34 so that its other end 174 is spaced downwardly from the sole 34.

The mounting member 170 preferably includes an outer shell 176 constructed of a hard but yieldable material and is filled with a softer elastomeric material 177 so that both the shell 176 and material 177 can deflect when subjected to a shear force. Furthermore, the outer circumfery 178 is inwardly concavely shaped.

The cleat 42 includes a hollow recess 180 which allows the cleat 42 to be snapped over the mounting member 170 and thus secured to the sole 34. Rotation of the cleat 42 with respect to the mounting member, however, is permitted.

With the cleat 42 secured to the mounting member as shown in FIG. 26, a laterally inside abutment surface 182 is positioned closely adjacent the bottom 44 of the sole 34 so that counter clockwise pivoting of the cleat 42 is precluded. Conversely, a notch 184 is provided in the sole 34 along the laterally outer side of the cleat 42 so that the laterally outer side of the cleat 42 is spaced from the bottom 44 of the sole 34.

As best shown in FIG. 27, in response to the laterally inward force indicated by arrow 46, the cleat 42 yields by pivoting in a clockwise direction. Additionally, the shell 176 and material 177 may deflect in response to a shear force. Conversely, yielding of the cleat is prevented by shear forces is other directions.

Figure 2:
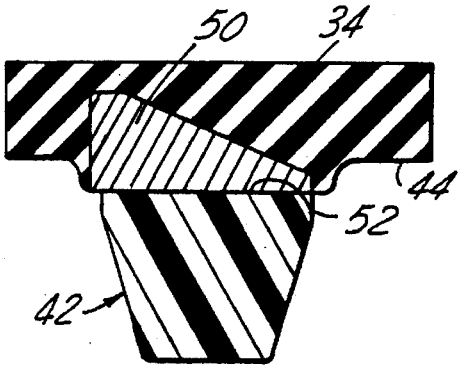
FIG. 2 is a cross sectional view illustrating a first embodiment of one cleat of the present invention.
Figure 3:
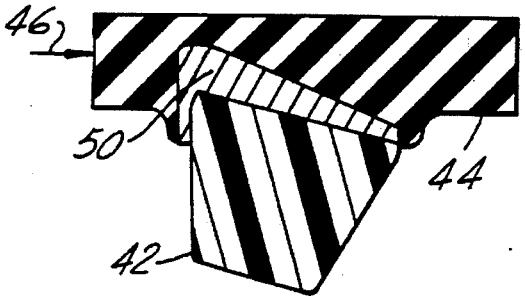
FIG. 3 is a view similar to FIG. 2, but illustrating the cleat in a transversely deformed position.

With reference then to FIGS. 2 and 3, a second preferred embodiment of the present invention is there shown in which the cleat 42 protrudes downwardly from the bottom 44 of the sole 34. The cleat 42 is preferably made of a hard rubber or hard plastic material.

A bumper 50 in interposed between a base 52 of the cleat 42 and the sole 34 of the shoe. This bumper 50 is constructed of an elastomeric material having a lower durometer than the cleat 42 so that the bumper 50 is softer than the cleat 42. Furthermore, as best shown in FIG. 2, this bumper 50 is in the form of a ramp which increases in thickness from a lateral inside of the cleat 42 to the lateral outside of the cleat 42. The bumper 50 is preferably at least partially embedded within the sole 34 of the shoe and any conventional means can be used to secure the bumper to both the cleat 42 and the sole 34.

As best shown in FIG. 3, in response to the lateral force indicated by arrow 46, the bumper compresses and allows lateral deformation or deflection of the cleat 42 by compressing the bumper 50 at its laterally outer side with the increased thickness. Conversely, lateral deformation of the cleat 42 is minimized, if not all together precluded, by a shear force imposed on the cleat 42 by the shoe in all other directions other than the laterally inward direction indicated by arrow 46.

Figure 4:
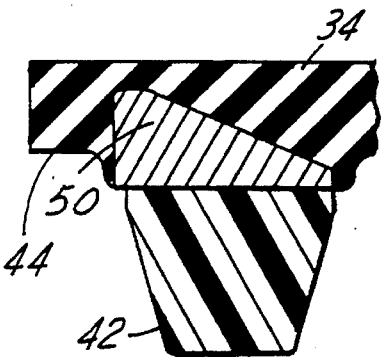
FIG. 4 is a cross sectional view of a second preferred embodiment of the cleat.
Figure 5:
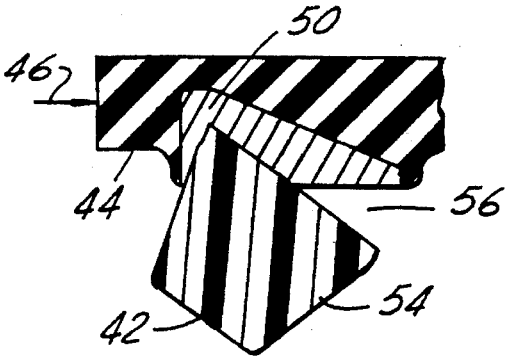
FIG. 5 is a view of the cleat illustrated in FIG. 4, but illustrating the cleat in a deformed condition.

With reference now to FIGS. 4 and 5, a still further embodiment of the present invention is there shown. Like the embodiment shown in FIGS. 2 and 3, the bumper 50 constructed of a soft elastomeric material is interposed between the cleat 42 and the sole 34. Like the bumper 50 shown in FIGS. 2 and 3, the bumper 50 in FIGS. 4 and 5 increases in thickness towards the lateral outer side of the sole 34.

As best shown in FIG. 5, unlike the embodiment of FIGS. 2 and 3, the cleat 42 is only attached to the upper 50 along a portion of its lateral outer half with respect to the longitudinal axis of the shoe. Consequently, upon imposition of a shear force in the direction of arrow 46, the bumper 50 compresses while the inner lateral half 54 of the cleat 42 separates from the bumper 50 as shown by space 56 thus producing increased deflection of the cleat 42.

Figure 6:
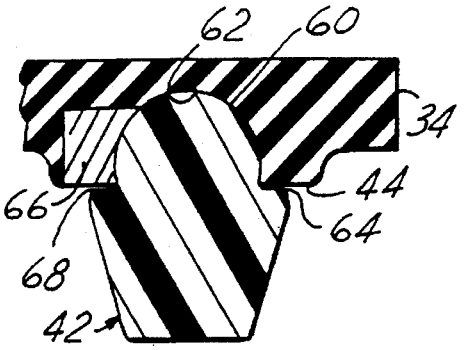
FIG. 6 is a cross sectional view illustrating still a further embodiment of one cleat of the present invention.
Figure 7:
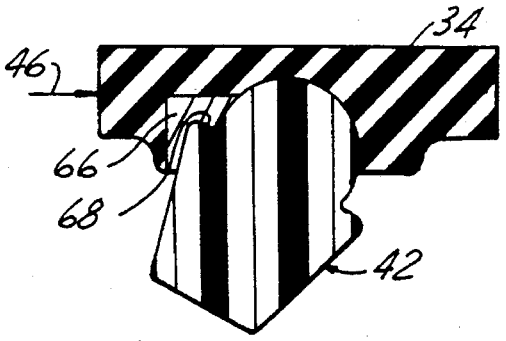
FIG. 7 is a view similar to FIG. 6, but illustrating a cleat in a deformed condition.

With reference now to FIGS. 6 and 7, a still further embodiment of the present invention is there shown in which the cleat 42 includes a cylindrical or spherical surface 60 along its base. This cylindrical surface 60 is nested within a like shape cylindrical or spherical surface 62 formed in the sole 34 of the shoe and is preferably secured to the sole 34 by a snap fit. Thus pivoting of the cleat 42 can occur with respect to the sole of the shoe about an axis parallel to the longitudinal axis of the shoe. Additionally, the cleat 42 is preferably rotatable about a verticle axis.

Still referring to FIGS. 6 and 7, the cleat 42 includes a generally horizontally extending abutment surface 64 which abuts against the bottom 44 of the sole 34. Consequently, the abutment surface 64 prevents pivotal movement of the cleat 42 in a counter clockwise direction as viewed in FIG. 6.

Still referring to FIGS. 6 and 7, a bumper 66 constructed of a soft elastomeric material is embedded within the sole 34 of the shoe so that the bumper 66 is positioned along the lateral outer side of the cleat 42. This bumper 66 registers with an abutment surface 68 formed on the lateral outer side of the cleat 42.

As best shown in FIG. 7, in response to a transverse force in the direction of arrow 46, the abutment surface 68 compresses the bumper 66 thus allowing the cleat 42 to laterally deform in the desired direction. Once the transverse force is indicated by arrow 46 ends, the bumper 66 returns the cleat 42 to its original position shown in FIG. 6.

Figure 8:
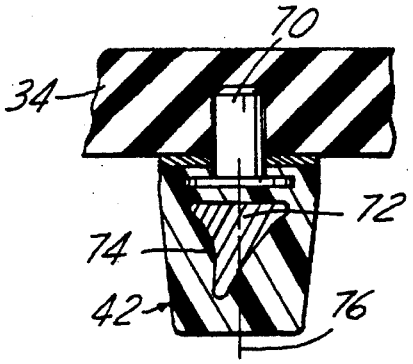
FIG. 8 is a cross sectional view illustrating still a further embodiment of one cleat of the present invention.
Figure 9:
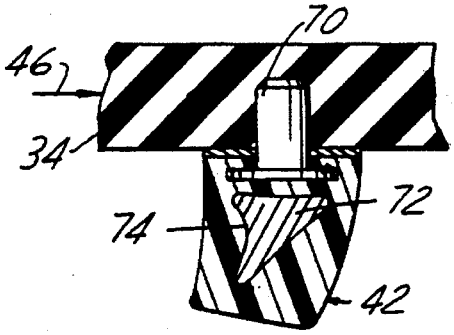
FIG. 9 is a view similar to FIG. 8, but illustrating a cleat in a deformed condition.

With reference now FIGS. 8 and 9, a still further modification of the present invention is there shown in which the cleat 42 is formed from a relatively hard elastomeric material. A post 70 is used to secure the cleat 42 to the sole 34 of the shoe.

The cleat 42 further includes an insert 72 which has a higher durometer than the portion of the cleats surrounding the insert 72. Furthermore, this insert 72 is generally triangular in shape but is asymmetrical with respect to the longitudinal axis of the shoe. As best shown in FIG. 8, the insert 72 also includes a generally concave surface 74 which faces laterally outwardly with respect to the longitudinal axis of the sole 34. Furthermore, the lower apex of the insert 72 is positioned to the laterally outer side of the axis 76 of the cleat 42.

As best shown in FIG. 9, upon the imposition of the lateral force the direction of arrow 46 upon the shoe, the cleat 42 deforms and, in doing so, compresses the concave face 74 of the insert 72. Conversely, the insert 72 resists deformation in all other shear directions due both to the asymmetrical positioning of the insert 72, together with the concave face 74 which will be in the state of tension during the imposition of shear force in a direction other than arrow 46.

Figure 10B:
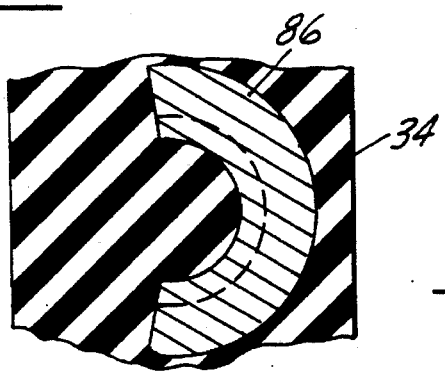

With reference now to FIGS. 10*a*, 10*b* and 11, a still further modification of the cleat 42 is there shown in which the cleat is constructed from a relatively hard elastomeric material, plastic or the like. The cleat 42 includes a boss 80 at its upper end which is received within a socket 82 formed in the sole 34 so that the cleat can rotate in the socket 82. The cleat 82 is preferably secured to the socket 82 by a snap fit.

The sole 34 includes an intermediate layer 84 which is constructed of a relatively soft elastomeric material. Additionally, the sole 34 includes a stop member 86 which is constructed of a harder elastomeric material than the layer 84. The stop member 86 registers with the laterally inner side of the socket 82.

As best shown in FIG. 10*b*, the stop member 86 extends preferably around an arc of a short 200°.

As best shown in FIG. 11, upon the imposition of a transverse force in the direction of arrow 46, the cleat 42 will laterally deform by compressing the sole layer 84. The inner lateral side of the socket 82, however, contacts the stop member 86 along an edge 88 thereby forcing the cleat 42 to pivot in a clockwise direction with respect to the longitudinal axis of the shoe by compressing the sole layer 84. The stop member 86, however, inhibits deformation of the cleat in response to all other shear forces other than in the direction of arrow 46.

With reference now to FIGS. 12 and 13, a still further embodiment of the invention is there shown in which the cleat 42 is preferably secured to the sole 34 by a post 90. The cleat 42 is preferably constructed from a relatively hard elastomeric material.

The cleat 42 includes a plurality of channels 92 which extend longitudinally with respect to the axis of the shoe through the clear 42. These channels 92, furthermore, are provided only along the outer lateral side of the cleat with respect to the longitudinal axis of the shoe.

A soft elastomeric material 94 fills each of the channels 92 as shown in FIG. 12. This elastomeric material 94 allows compression but resists tension.

As best shown in FIG. 13, upon the imposition of a transverse force in the direction of arrow 46, the cleat 42 laterally deforms by compressing the soft material 94 in the channels 92. Conversely, since the material 94 resists tension, lateral deformation of the cleat 42 is minimized in all other shear directions.

With reference now to FIGS. 14–16, a still further preferred embodiment of the present invention is there shown in which the cleat 42 includes a mounting plate 100 which is secured to the sole 34 by a post 102. The post 102 registers with a channel 104 formed in the mounting plate 100 so that the mounting plate 100 can move laterally in one direction by displacement of the post 102 in the channel 104. A resilient bumper 106, (FIG. 14), however, is disposed in the channel 104 which urges the post 102 to a center position with respect to the plate 100 and returns the mounting plate 100 to its center position in the event of displacement of the plate 100 with respect to the post 102.

As best shown in FIG. 15, the mounting plate 100 preferably includes downwardly extending flanges 108 and 110 along both the front and rear sides of the cleat with respect to the longitudinal axis of the shoe. A similar mounting flange 112 is provided along the laterally inner side of the mounting plate 100 and thus at the end of the channel 104.

Any conventional means, such as a locknut 105, can be used to properly orient the channel 104 with respect to the longitudinal axis of the sole 34.

With reference now particularly to FIG. 14, the cleat 42 includes a first part 114 which is secured to the mounting plate 100. A second part 116 of the cleat 42 includes a cylindrical boass 118 which is received with a cylindrical socket 120 of the first part 114 So that the second part 116 of the cleat 42 can rotate with respect to the axis of the post 102.

With reference now especially to FIG. 16, in the event of the imposition of a transverse force on the sole 34 in the direction of arrow 46, the mounting plate 100 together with its attached cleat 42 deflects laterally outwardly by displacing the post 102 in the channel 104. Once the transverse force in the direction of arrow 46 in terminated, the bumper 106 returns the cleat 42 to its undeflected position illustrated in FIG. 14.

With reference now to FIGS. 17 and 18, a still further modification of the present invention is there shown in which the cleat 42 is constructed from a relatively soft elastomeric material and is secured to the sole 34 by a post 120. This embodiment of the cleat 42 is designed for use on a court so that the cleat 42 grips rather than embeds in the ground support surface. The same is true for the subsequently described FIGS. 19–25 embodiments.

The cleat 42 is generally rectangular in cross sectional shape. A longitudinally extending slit 122 is provided through the cleat 42 and terminates by a hole 123 thus dividing the cleat 42 into a laterally outer half 124 and laterally inner half 126. Furthermore, as best shown in FIG. 17, the slit 122 does not extend vertically through the cleat 42 but, instead, is angled laterally inwardly from a lower end 128 of the cleat 42 towards the sole 34.

With reference now particularly to FIG. 18, in the event of an imposition of a transverse force in the direction of arrow 46 on the sole 34, the facing sides 130 and 132 of the slit 122 slide past each other thus allowing the cleat 42 to laterally outwardly deform. The hole 123 also facilitates sliding action between the cleat halves 124 and 126 in response to a shear force in the direction of arrow 146. Conversely, due to the lateral angle of the slit 122, the imposition of a shear force in directions other than the arrow 46 will cause the facing sides 132 and 130 of the slit 122 to interfere with each other and bind thereby minimizing deflection of the cleat 42 in the desired fashion.

Still referring to FIGS. 17 and 18, the outer lateral part 124 of the cleat 42 preferably includes a longitudinally extending notch 134 formed through it. This notch 134 and hole 123 also enhance lateral deformation of the cleat 42 in response to a shear force in the direction of arrow 46 but, otherwise, resists lateral deformation of the cleat 42.

With reference now to FIGS. 19–21, a still further modification of the present invention is there shown in which a plurality of cleats 42 are provided at longitudinally spaced positions along the sole 34 of the shoe. Each cleat 42 is constructed from a soft elastomeric material.

As best shown in FIG. 20, each cleat 42 includes a plurality of longitudinally extending slits 140 formed through it which terminates at a hole 141 which functions like the hole 123 in the FIG. 17–18 embodiment. These slits 140, like the slit 122 in the FIG. 17–18 embodiment, are laterally angled from an outer lateral side of the shoe at a lower portion 142 of the cleat 42 and laterally inwardly and upwardly extend towards the sole 34. Thus, the cleat 42 is subdivided into a plurality of cleat segments 144 which are positioned laterally adjacent each other with respect to the longitudinal axis 36 of the sole 34.

With reference now particularly to FIG. 21, in response to the imposition of a shear force in the direction of arrow 46 on the sole 34, the cleat segments 144 deform laterally outwardly by sliding displacement between the cleat segments 144. Conversely, due to the lateral angle of the slits 140, lateral deflection of the cleat segments 144 in the direction opposite from the arrow 46 cause the cleat segments 144 to bind against each other thus resisting lateral deflection. Deflection of the cleat 42 in other shear directions is also minimized since the cleats bind against each other.

It has been found that the FIG. 19–21 embodiment with the cleats with the laterally angled slit provide adequate traction for athletes engaging in sports on hard surfaces an yet yield in response to a laterally inward shear force.

With reference to FIGS. 22–25, a still further modification of the present invention is thereshown in which a plurality of cleats 42 are provided at longitudinally spaced positions along the sole 34 of the shoe. Each cleat 42 is constructed from a relatively soft elastomer material.

As best shown in FIG. 23, each cleat 42 includes a plurality of longitudinally extending slits 190 formed through it which terminate at a hole 191. These slits 190 like the slits 140 in the FIG. 19–21 embodiment, are laterally angled from an outer lateral side of the shoe at a lower portion 192 of the cleat 42 and upwardly and inwardly towards the sole 34. Thus, the cleat 42 is subdivided into a plurality of cleat segments 194 which are positioned laterally adjacent each other with respect to the longitudinal axis 36 of the sole 34.

As best shown in FIGS. 22 and 25, each cleat 42 includes a slit 196 which extends laterally with a respect to the longitudinal axis of the shoe.

With reference now particularly to FIG. 25, in response to the imposition of a shear force in the direction of arrow 46 on the sole 34, the cleat segments 194 deform laterally outwardly by sliding displacement among the cleat segments 194. Conversely, due to the lateral angle of the slits 190, lateral deflection of the cleat segments 194 in the direction opposite from the arrow 46 cause the cleat segments 194 to bind against each other thus resisting lateral outward deflection. Deflection of the cleat 42 in other shear directions is also minimized since the cleats bind against each other.

As best shown in FIG. 25, the lateral slit 196 effectively subdivides the cleat 42 into smaller cleat segments 194. These small cleat segments 194 traction by allow enhance pivoting as shown in FIG. 25 by deflecting relative to each other.

With reference now to FIGS. 28 and 29, a still further modification of the present invention is there shown in which a longitudinally extending U-shaped compression slot 150 is provided between the lateral outer portion of the cleat and the sole 34. As best shown in FIG. 29, composition of a lateral inward force in the direction of arrow 46 causes the cleat to deform or deflect by closing the compression slot 150. Deflection in response to shear forces in other directions, however, is resisted.

From the foregoing, it can be seen that the present invention provides a unique cleat for an athletic shoe which increases the safety of the shoe in response to the imposition of a laterally inward force on the shoe without loss of traction.

Having described my invention, however, many modifications there to will become apparent to those skilled in the art to which it pertains without deviation from the spirit of the invention as defined by the scope of the appended claims.

I claim:

1. A cleated athletic shoe comprising:

an upper foot-holding portion;

a sole attached to said upper portion, said sole having a lower substantially planar surface and a longitudinal axis extending along the length thereof;

a plurality of cleat members attached to said sole;

means for permitting a greater magnitude of lateral deflection of said cleat members in response to a predetermined shear force imposed thereon in a first lateral direction with respect to said longitudinal direction than a deflection in response to said predetermined shear force in directions other than said first lateral direction.

2. The athletic shoe as set forth in claim 1 wherein said cleat members are formed integrally with said sole.

3. The athletic shoe as set forth in claim 1 wherein said cleat members each have at least one slit therein.

4. An athletic shoe in combination with a cleat assembly, said shoe having an upper portion and a sole having a longitudinal axis, said cleat assembly comprising:

a cleat, means for mounting said cleat to the sole so that said cleat depends outwardly from the sole, means for enabling a greater magnitude of lateral deflection of said cleat in response to a predetermined shear force imposed on the cleat in a first lateral direction with respect to the longitudinal axis of the shoe than deflection of the cleat in response to said predetermined shear force imposed on the cleat in directions other than aid first lateral direction.

5. An athletic shoe having an upper portion and a lower ground engageable lower portion, said shoe having a longitudinal axis along the length thereof, said shoe comprising:

at least one deflectable cleat means attached to said lower portion, enabling means for enabling a greater magnitude of lateral deflection of said cleat means in response to a predetermined shear force imposed on said cleat means in a first lateral direction with respect to said longitudinal axis than deflection of the cleat in response to said predetermined shear force imposed on said cleat means in directions other than said lateral direction, said enabling means comprising a slit in said cleat means.

6. An athletic shoe as claimed in claim 5 wherein said cleat means comprises a plurality of separate cleat members, at least one with a slit therein.

7. An athletic shoe as claimed in claim 5 wherein said cleat means comprises a plurality of separate cleat members, each of said members having a slit therein.

8. An athletic shoe as claimed in claim 5 wherein said slit is positioned at an angle to said lower portion of said shoe.

9. An athletic shoe as claimed in claim 5 wherein said cleat means comprises at least one laterally elongated member with a plurality of parallel slits therein.

* * * * *

UNITED STATES PATENT AND TRADEMARK OFFICE

CERTIFICATE OF CORRECTION

PATENT NO. : 5,505,012

DATED : April 9, 1996

INVENTOR(S) : Walker et al.

It is certified that error appears in the above-indentified patent and that said Letters Patent is hereby corrected as shown below:

Abstract, line 12, delete "direction" and insert -- directions --;

Column 1, line 44, after "surface" insert -- . --;

Column 2, line 13, delete "drawing" and insert -- Drawings --;

Column 2, line 15, delete "an" and insert -- and --;

Column 4, line 10, after "forces" replace "is" with -- in --;

Column 6, line 1, after "through the" replace "clear" with -- cleat --;

UNITED STATES PATENT AND TRADEMARK OFFICE

CERTIFICATE OF CORRECTION

PATENT NO. : 5,505,012

DATED : April 9, 1996

INVENTOR(S) : Walker et al

It is certified that error appears in the above-indentified patent and that said Letters Patent is hereby corrected as shown below:

Column 6, line 38, replace "boass" with -- boss --.

Column 6, line 39, replace "So" with -- so --;

Column 6, line 47, replace "in" (2nd occurrence) with -- is --;

Column 7, line 45, replace "an" with -- and --;

Column 7, line 51, replace "elastomer" with -- elastomeric --;

Column 8, line 65, replace "aid" with -- said --.

Signed and Sealed this

Twelfth Day of November, 1996

*Attest:*

*Attesting Officer*

BRUCE LEHMAN

*Commissioner of Patents and Trademarks*